US008534000B1

(12) United States Patent
Fadlon

(10) Patent No.: US 8,534,000 B1
(45) Date of Patent: Sep. 17, 2013

(54) PANEL AND FRAME SYSTEM

(76) Inventor: Moshe Fadlon, Ramat Itzhak (IL)

( * ) Notice: Subject to any disclaimer, the term of this patent is extended or adjusted under 35 U.S.C. 154(b) by 0 days.

(21) Appl. No.: 13/442,153

(22) Filed: Apr. 9, 2012

(51) Int. Cl.
*E06B 1/04* (2006.01)

(52) U.S. Cl.
USPC ..... 49/504; 49/501; 49/398; 49/400

(58) Field of Classification Search
USPC ..... 49/381, 397, 398, 399, 400, 501, 49/504
See application file for complete search history.

(56) References Cited

U.S. PATENT DOCUMENTS

| | | | | | |
|---|---|---|---|---|---|
| 577,983 | A * | 3/1897 | Hoffmann | 16/375 |
| 984,034 | A * | 2/1911 | Seipp | 49/398 |
| 1,249,516 | A * | 12/1917 | Schell | 16/374 |
| 1,257,572 | A * | 2/1918 | Appleby | 16/266 |
| 1,837,916 | A * | 12/1931 | Michelman | 49/367 |
| 1,893,450 | A * | 1/1933 | Shively | 49/383 |
| 1,925,635 | A * | 9/1933 | Hartley | 49/400 |
| 1,959,287 | A * | 5/1934 | Helmer | 49/208 |
| 2,163,323 | A * | 6/1939 | Howe | 296/151 |
| 3,159,093 | A * | 12/1964 | Rosenfeld | 49/401 |
| 3,212,140 | A * | 10/1965 | Byrka | 49/261 |
| 4,044,503 | A * | 8/1977 | Maune | 49/400 |
| 4,073,093 | A * | 2/1978 | Ookawa et al. | 49/381 |
| 4,179,790 | A * | 12/1979 | Tornerfelt | 29/416 |
| 4,534,132 | A * | 8/1985 | Smith | 49/386 |
| 4,535,908 | A * | 8/1985 | Dabich | 220/484 |
| 4,979,264 | A * | 12/1990 | Ramsauer | 16/264 |
| 5,001,863 | A * | 3/1991 | Uppstrom | 49/399 |
| 5,187,897 | A * | 2/1993 | Maidment | 49/236 |
| 5,205,073 | A * | 4/1993 | Lyons, Sr. | 49/386 |
| 5,283,979 | A * | 2/1994 | Carlson et al. | 49/395 |
| 5,542,215 | A * | 8/1996 | Kubo | 49/397 |
| 5,850,710 | A * | 12/1998 | Brock | 49/141 |
| 6,170,210 | B1 * | 1/2001 | Marts | 52/232 |
| 8,166,706 | B2 * | 5/2012 | Slimak et al. | 49/386 |
| 8,276,320 | B2 * | 10/2012 | Erbrect et al. | 49/471 |
| 2007/0151164 | A1 * | 7/2007 | Marshall | 49/397 |
| 2011/0120021 | A1 * | 5/2011 | Lim | 49/399 |

* cited by examiner

*Primary Examiner* — Jerry Redman
(74) *Attorney, Agent, or Firm* — Law Offices of Steven W. Weinrieb

(57) ABSTRACT

A panel and frame system comprising a frame and a panel is disclosed. The panel is hinged to the frame by at least one hinge. The frame comprises a hinge jamb adjacent the at least one hinge and a lock jamb opposite the hinge jamb. When the panel and frame system is in a closed position, an outer face of the at least one panel is co-planar with an outer hinge jamb side and an outer lock jamb side of the hinge jamb and an inner face of the at least one panel is coplanar with an inner hinge jamb side and with an inner lock jamb side.

8 Claims, 7 Drawing Sheets

PANEL AND FRAME SYSTEM

FIELD OF THE INVENTION

Disclosed is a lockable panel and frame system. In particular, the pan-el and frame system may possess a high level of aesthetic finish and high sta-bility from a mechanical point of view, despite allowing relatively quick and easy mounting.

BACKGROUND OF THE INVENTION

Generally, a panel, such as, for example, but not limited to, doors of rooms and/or apartments, windows, and any similar lockable panel, are used to separate neighboring spaces, or to provide entry into particular spaces.

It would be desirable to have a panel and frame system which may offer higher levels of aesthetic finish and high stability from a mechanical point of view. This may be attained with the subject matter set forth in this disclosure as well as in accordance with the attached claims.

SUMMARY OF THE INVENTION

In the following disclosure, aspects thereof are described and illustrated in conjunction with systems and methods which are meant to be exemplary and illustrative, and not limiting in scope.

The present invention is broadly related to a panel and frame system comprising a frame and at least one panel. According to one aspect of the present invention, the panel may be hinged to the frame by at least one hinge. The frame may comprise a hinge jamb adjacent the at least one hinge and a lock jamb opposite the hinge jamb. When the panel and frame system is in a closed position, an outer face of the at least one panel may be coplanar with an outer hinge jamb side and an outer lock jamb side of the hinge jamb and the lock jamb, respectively, while an inner face of the at least one panel may be co-planar with an inner hinge jamb side and an inner lock jamb side of the hinge jamb and the lock jamb, respectively.

The at least one panel may comprise a hinge stile adjacent the at least one hinge and a lock stile opposite the hinge stile.

Furthermore, the hinge stile may have a hinge stile face and the lock stile may have a lock stile face, with the hinge stile face and the lock stile face extending between, and generally transverse to, the inner face and the outer face of the panel.

Optionally, the hinge jamb may comprise a hinge jamb face extending between the outer hinge jamb side and the inner hinge jamb side and generally transverse thereto, and the lock jamb may comprises a lock jamb face extending between the outer lock jamb side and the inner lock jamb side and generally transverse thereto.

Furthermore, the hinge stile face may oppose and correspond to the hinge jamb face, and/or the lock stile face may oppose and correspond to the lock jamb face.

Still further, the hinge jamb face may comprise an outside hinge jamb face adjacent to the outer hinge jamb side, meeting therewith and extending generally transversely thereto, an inside hinge jamb face adjacent the inner hinge side, meeting therewith and extending generally transversely thereto, with the outside hinge jamb face extending away from the outer hinge jamb side so as to meet a hinge jamb step, extending away therefrom and generally transversely thereto, towards the inside hinge jamb face.

Still yet further, the lock jamb face may comprise an outside lock jamb face adjacent to the outer lock jamb side, meeting therewith and extending generally transversely thereto, and an inside lock jamb face adjacent to the inner lock side, meeting therewith and extending generally transversely thereto. The outside lock jamb face extends away from the outer lock jamb side so as to meet a lock jamb step, extending away therefrom and generally transversely thereto, towards the inside lock jamb face.

Moreover, the hinge stile face may comprise an outside hinge stile face adjacent to the outer hinge stile side, meeting therewith and extending generally transversely thereto, and an inside hinge stile face adjacent to the inner hinge side meeting therewith and extending generally transversely thereto. The outside hinge stile face extends away from the outer hinge stile side so as to meet a hinge stile step, extending away therefrom and generally transversely thereto, towards the inside hinge stile face.

Furthermore, the lock stile face may comprise an outside lock stile face adjacent to the outer lock stile side, meeting therewith and extending generally transversely thereto, and an inside lock stile face adjacent to the inner lock side meeting therewith and extending generally transversely thereto, the outside lock stile face extending away from the outer lock stile side so as to meet a lock stile step, extending away therefrom and generally transversely thereto, towards the inside lock stile face.

Optionally, the outside hinge stile face opposes the outside hinge jamb face, the inside hinge stile face opposes the inside hinge jamb face, and the hinge stile step opposes the hinge jamb step.

Still further, the outside lock stile face opposes the outside lock jamb face, the inside lock stile face opposes the inside lock jamb face, and the lock stile step opposes the lock jamb step.

According to another aspect of the present invention, there is provided a panel and frame system comprising a frame and at least one panel, the panel being hinged to the frame by at least one hinge, the frame comprises a lock jamb opposite a hinge jamb adjacent to the at least one hinge, the at least one panel comprises a lock stile adjacent the lock jamb when the panel and frame system is in a closed position, the lock stile having a lock stile face extending between and generally transverse to an inner face and an outer face of the panel, and comprises an inside lock stile face adjacent to the inner face of the panel, meeting therewith and extending generally transversely thereto, the lock jamb having a lock jamb face extending between an outer lock jamb side and an inner lock jamb side and generally transverse thereto and comprises an inside lock jamb face adjacent the inner lock jamb side, meeting therewith and extending generally transversely thereto, and wherein an at least one retractable bolt is displaceable between a retracted position and an extended position so that when in the retracted position, the at least one bolt is be accommodated by the at least one panel, and in the extended position, the at least one bolt extends away from the inside lock stile face and through the inside lock jamb face.

In addition to the exemplary aspects and embodiments described, further aspects and embodiments will become apparent by reference to the figures and by study of the following detailed description.

BRIEF DESCRIPTION OF DRAWINGS

Exemplary and/or illustrative embodiments of the present invention will be presented herein below in the following figures, by way of example only. The figures are not necessarily to scale, and some features may be exaggerated or minimized and/or roughly shown and/or omitted entirely, to show details of particular components, intending that the present disclosure may be-come more fully understood from the detailed description and the accompany-ing schematic figures, wherein.

DETAILED DESCRIPTION OF AN EMBODIMENT

Figure 1A:
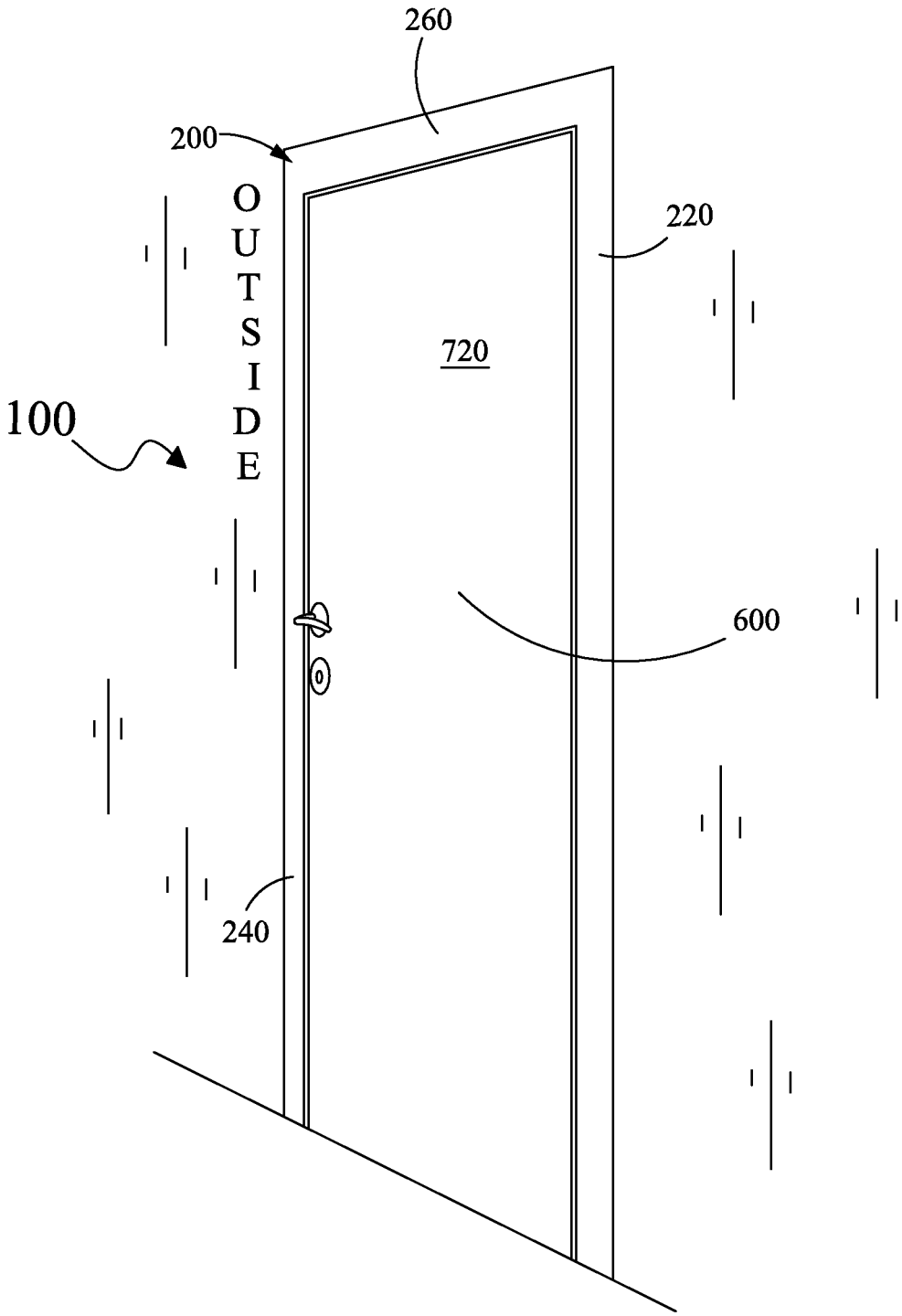
FIG. 1A is a perspective view of the outside of an embodiment of a panel and frame system in a closed position in accordance with the present invention.
Figure 1B:
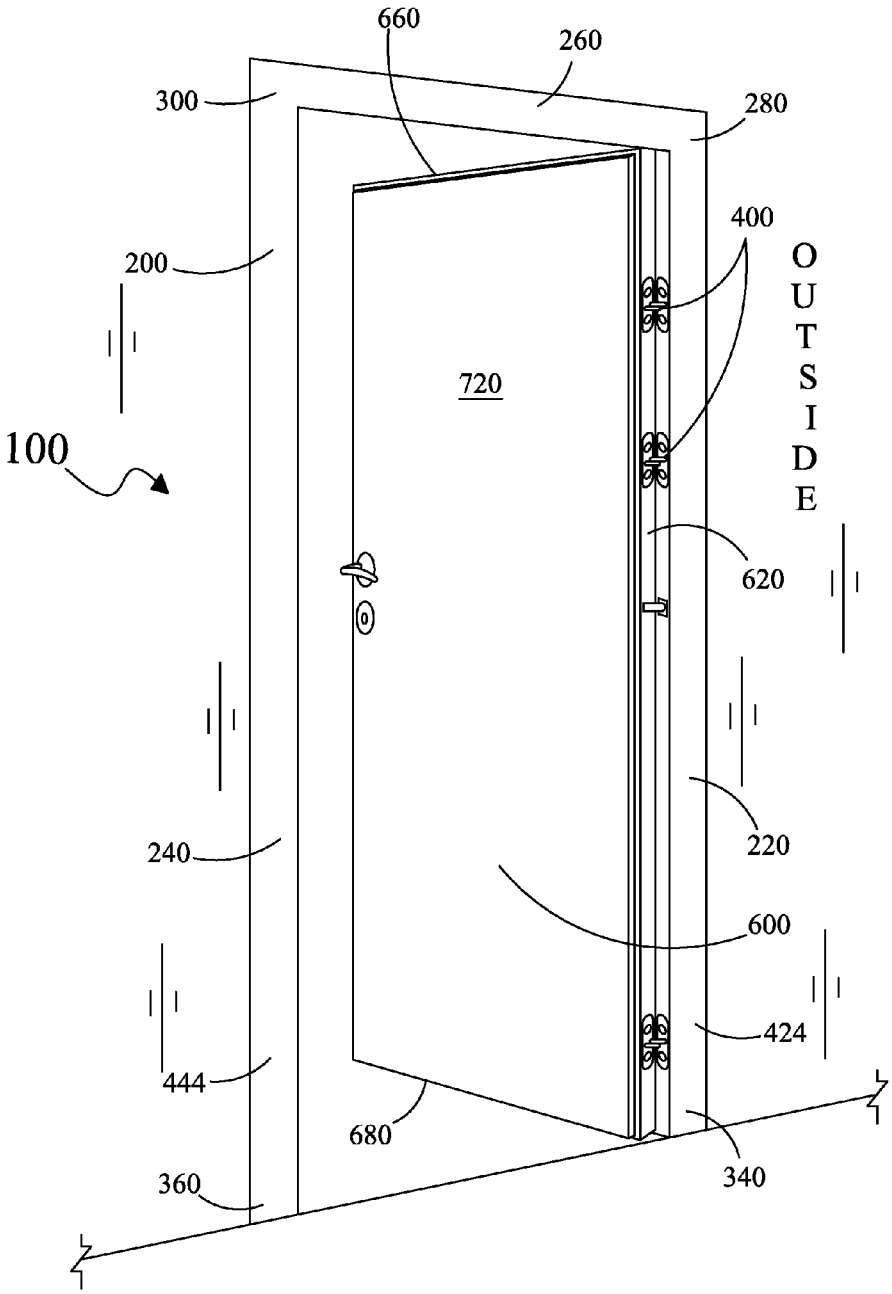
FIG. 1B is a perspective view of the outside of the panel and frame system of FIG. 1A in an open position.
Figure 1C:
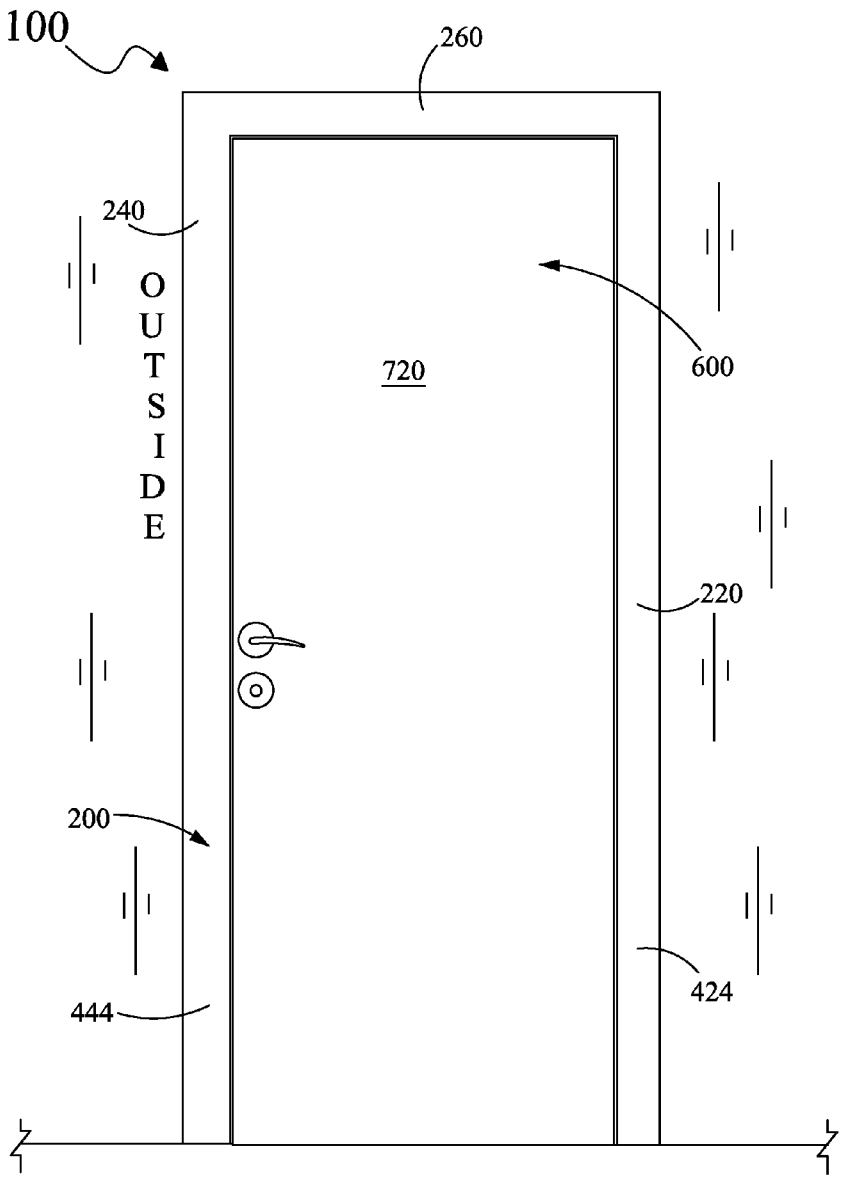
FIG. 1C is a front elevational view of the outside of the panel and frame system of FIG. 1A in the closed position.
Figure 1D:
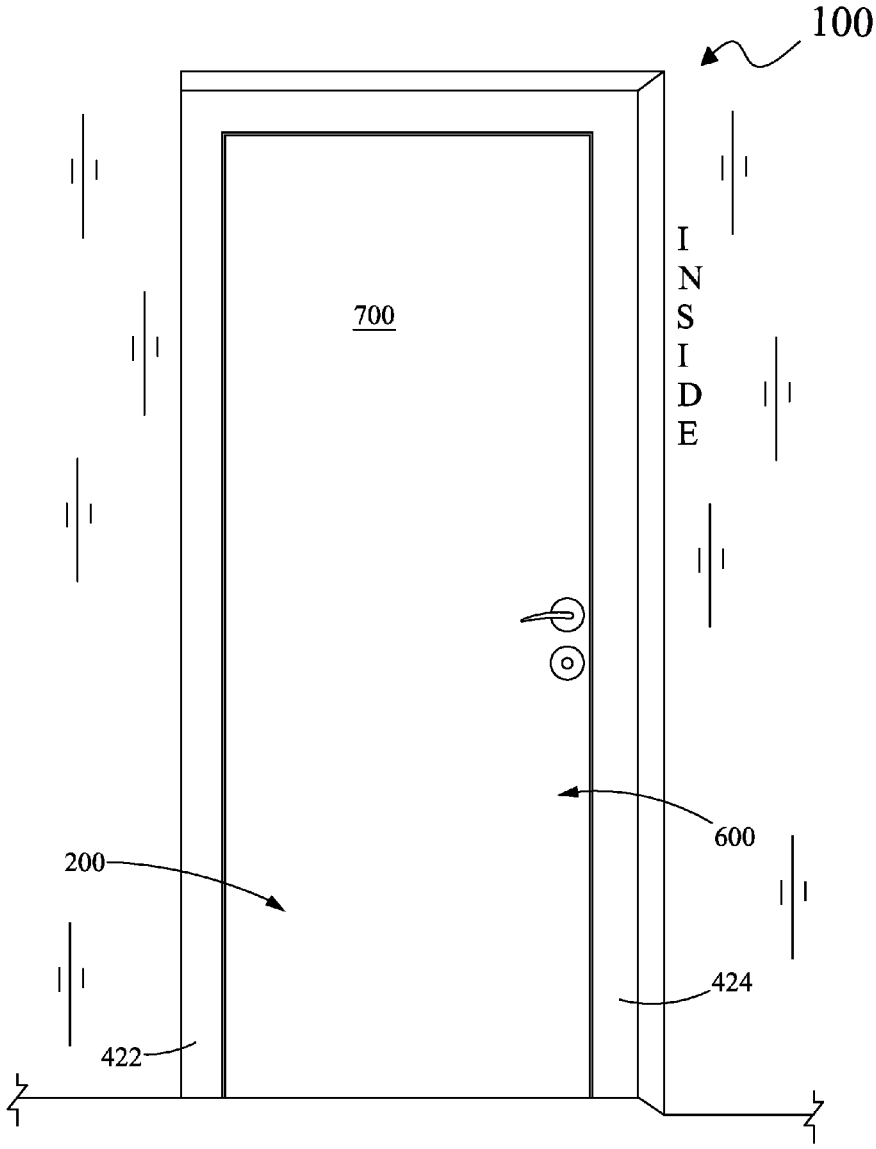
FIG. 1D is a front elevational view of the inside of the panel and frame system of FIG. 1A in the closed position.
Figure 2:
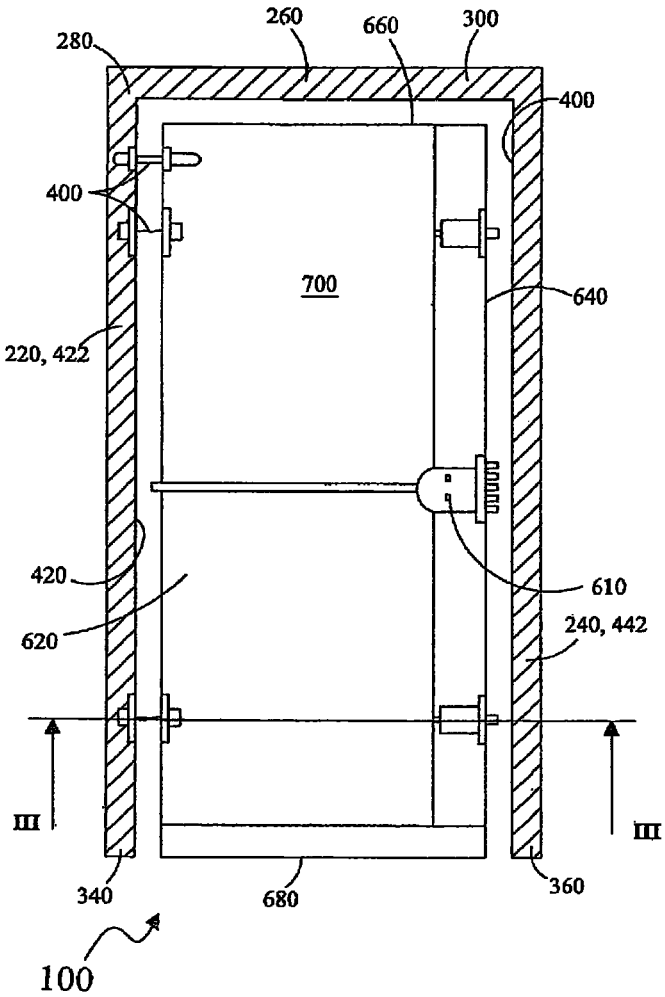
FIG. 2 schematically illustrates the panel and frame system shown in FIG. 1*a* with a side plate of the panel removed.
Figure 3:
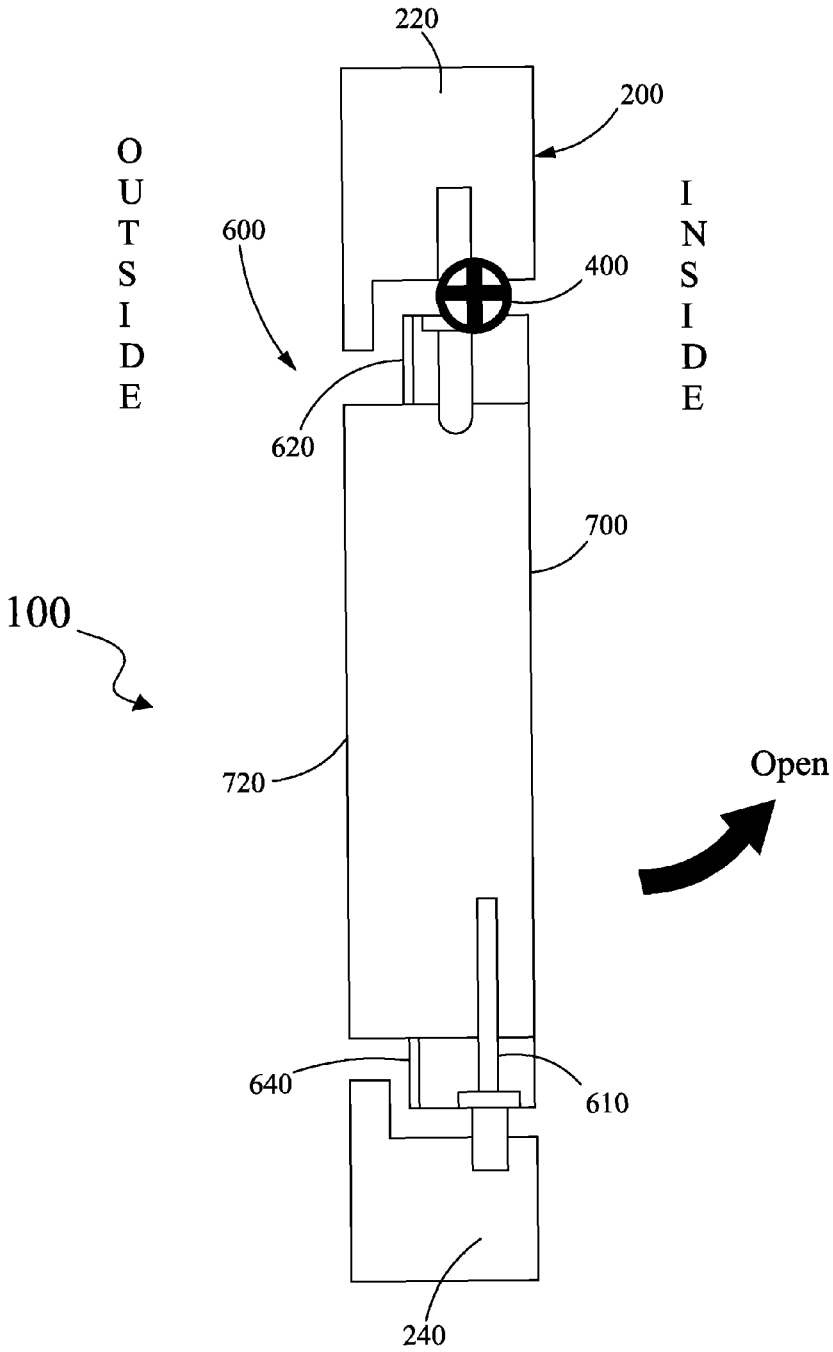
FIG. 3 is a schematic cross section view of the panel and frame system taken along the line III-III in FIG. 2.
Figure 4:
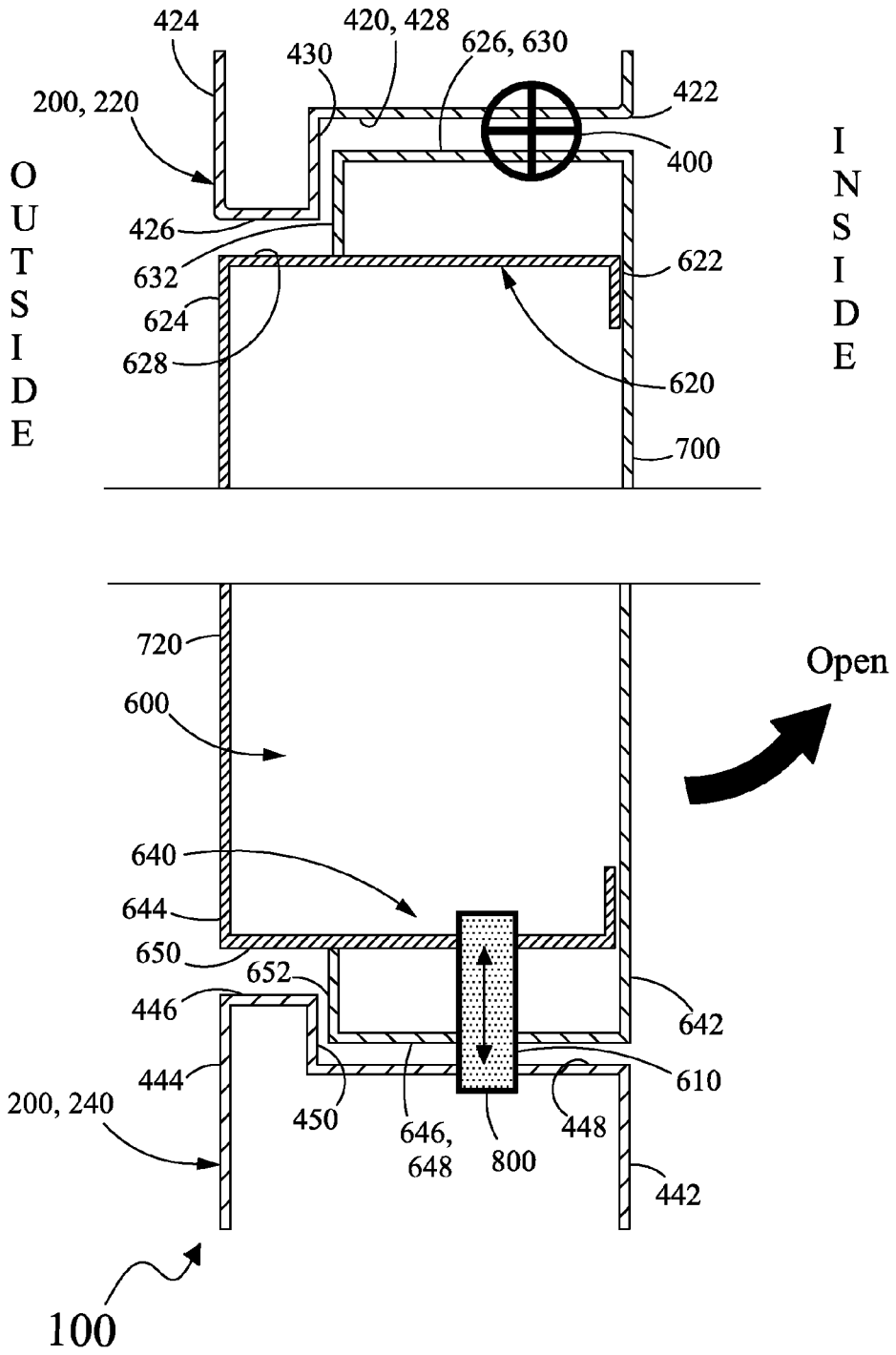
FIG. 4 is an enlarged partial cross section view of the panel and frame system shown in FIG. 3.

Attention is presently drawn to the figures. An exemplary embodiment of a panel and frame system 100 is schematically illustrated. While this particular embodiment shows a door, the spirit and scope of the invention relates to doors, windows, shutters, hatches, and other similar closures. The panel and frame system 100 comprises a frame 200 and at least one panel 600. The at least one panel 600 may be hinged to the frame 200 by a plurality of hinges 400 so as to facilitate the swinging of the panel 600 between a closed position and an open position. The at least one panel 600 may additionally be locked to the frame 200 so as to disable swinging on occasions. A direction in which the at least one panel 600 may swing from the closed position towards the open position may be labeled as the 'inwards' direction, defining an 'inside' label to one side of the at least one panel and frame system 100 and an 'outside' label to an opposing side of the at least one panel and frame system 100.

The frame 200 comprises a hinge jamb 220 along which the plurality of hinges 400 may be installed, and a lock jamb 240 opposing the hinge jamb 220. A head 260 may bridge the top 280 of the hinge jamb 220 and the top 300 of the lock jamb 240. An optional sill (not shown) may bridge the bottom 340 of the hinge jamb 220 and the bottom 360 of the lock jamb 240.

The hinge jamb 220 comprises opposing inner and outer hinge jamb sides 422,424 respectively, with a hinge jamb face 420 extending therebetween and transversely thereto. The hinge jamb face 420 comprises an outside hinge jamb face 426 adjacent the outer hinge jamb side 422, meeting therewith and extending generally transversely thereto. The hinge jamb face 420 further comprises an inside hinge jamb face 428 adjacent the inner hinge side 424, meeting therewith and extending generally transversely thereto. The outside hinge jamb face 426 extends away from the outer hinge jamb side 424 to meet a hinge jamb step 430 extending away therefrom and generally transversely thereto towards the inside hinge jamb face 428. The hinge jamb step 430 faces generally inside.

Similarly, the lock jamb 240 comprises opposing inner and outer lock jamb sides 442,444 respectively, with a lock jamb face 440 extending there-between and transversely thereto. The lock jamb face 440 comprises an outside lock jamb face 446 adjacent the outer lock side 442, meeting therewith and extending generally transversely thereto. The lock jamb face 440 further comprises an inside lock face 448 adjacent the inner lock side 444, meeting therewith and extending generally transversely thereto. The outside lock face 446 extends away from the outer lock jamb side 444 so as to meet a lock jamb step 450 extending away therefrom and generally transversely thereto towards the inside lock jamb face 448. The lock jamb step 450 faces generally inside.

The at least one panel 600 comprises a hinge stile 620 hinged to the hinge jamb 220, while at least one lock 610 may be disposed on the at least one panel 600 adjacent a lock stile 640 thereof, so that when the at least one panel is in the closed position, the lock stile 640 is adjacent to the lock jamb 240. The at least one panel 600 extends from a top end 660 adjacent to the head 260 when the at least one panel 600 is in the closed position, to a bottom end 680 opposite thereto. The at least one panel 600 further comprises an inner face 700 and an outer face 720, with the top end 660, bottom end 680, hinge stile 620, and lock stile 640 extending between the inner face 700 and the outer face 720.

The hinge stile 620 comprises opposing inner and outer hinge stile sides 622,624 respectively with a hinge stile face 626 extending therebetween and transversely thereto. The inner hinge stile side 622 merges with the inner face 700 and the outer hinge stile side 624 merges with the outer face 720. The hinge stile face 620 comprises an outside hinge stile face 628 adjacent to the outer hinge stile side 622, meeting therewith and extending generally transversely thereto. The hinge stile face 626 further comprises an inside hinge stile face 630 adjacent to the inner hinge stile side 624, meeting therewith and ex-tending generally transversely thereto. The outside hinge stile face 628 extends away from the outer hinge stile side 622 so as to meet a hinge stile step 632 extending away therefrom and generally transversely thereto towards the inside hinge stile face 630. The hinge stile step 632 faces generally outside.

Similarly, the lock stile 640 comprises opposing inner and outer lock stile sides 642,644 respectively with a lock stile face 646 extending there-between and transversely thereto. The inner lock stile side 642 merges with the inner face 700 and the outer lock stile side 644 merges with the outer face 720. The lock stile face 646 comprises an outside lock stile face 648 adjacent to the outer lock stile side 642, meeting therewith and extending generally transversely thereto. The lock stile face 646 further comprises an inside lock stile face 650 adjacent to the inner lock stile side 644, meeting therewith and extending generally transversely thereto. The outside lock stile face 648 and the inside lock stile face 650 meet at a lock stile step 652 extending therebetween and generally transversely thereto, and facing outside.

When the panel and frame system 100 is in the closed position, the outer face 720 of the at least one panel 600 is coplanar with the outer hinge jamb side 424 and with the outer lock jamb side 444. The inner face 700 of the at least one panel 600 is coplanar with the inner hinge jamb side 422 and with the inner lock jamb side 442. The hinge jamb face 420 faces the hinge stile face 626, with the outside hinge jamb face 426 facing the outside hinge stile face 628. The inside hinge jamb face 428 faces the inside hinge stile face 630 and the hinge jamb step 430 faces the hinge stile step 632. Similarly, the lock jamb face 440 faces the lock stile face 646, with the outside lock jamb face 446 facing the outside lock stile face 648. The inside lock jamb face 448 faces the inside lock stile face 650 and the lock jamb step 430 faces the lock stile step 652.

The at least one panel 600 may optionally comprise at least one retractable bolt 800 capable of moving between a retracted position and an extended position. In the retracted position, the at least one bolt 800 may be contained at least mostly within the at least one panel 600. Assuming, as an illustrative-only, non-limiting example, that the at least one bolt 800 is located adjacent to the lock stile 640, then, in the extended position, the at least one bolt 800 extends away from the lock stile face 646 and through the lock jamb face 440 so as to penetrate into, and engage, the lock jamb 240. However, similar bolts may be located adjacent the top end 660, the bottom end 680, and/or adjacent to the hinge stile 620 and may extend so as to engage the head 260, the sill (not shown), or the hinge jamb 220. Alternatively, at least one bolt may be accommodated within the lock jamb, the hinge jamb, the head and/or the sill, when converged, and penetrate into, and engage, the lock stile, hinge stile, top end, and/or the bottom end, respectively.

When the panel and frame system 100 is in the closed position, the at least one bolt 800, as well as the plurality of hinges 400, may be protected from direct approach from the outside by the hinge jamb step 430 and its associated facing and opposing hinge stile step 632 and its associated facing and opposing lock jamb step 450 faces the lock stile step 652. These, together with the at least one panel 600 being coplanar with the outer hinge jamb side 424 and with the outer lock jamb side 444, and with the inner face 720 of the at least one panel 600 being coplanar with the inner hinge jamb side 422 and with the inner lock jamb side 442, offer the closed panel and frame system enhanced aesthetics together with increased safety and security.

All directional references (such as, but not limited to, upper, lower, inner, outer, upward, downward, inwards, outwards, right, left, rightward, leftward, inside, outside, top, bottom, above, below, vertical, horizontal, clockwise, and counterclockwise, lineal, axial and/or radial, or any other directional and/or similar references) are only used for identification purposes to aid the reader's understanding of illustrative embodiments of the present disclosure, and may not create any limitations, particularly as to the position, orientation, or use unless specifically set forth in the claims.

Similarly, joinder references (such as, but not limited to, attached, coupled, connected, accommodated, and the like and their derivatives) are to be construed broadly and may include intermediate members between a connection of segments and relative movement between segments. As such, joinder references may not necessarily infer that two segments are directly connected and in fixed relation to each other.

In some instances, components are described with reference to "ends" having a particular characteristic and/or being connected with another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular segment, link, component, part, member or the like. Additionally, all numerical terms, such as, but not limited to, "first", "second", "third", "fourth", or any other ordinary and/or numerical terms, should also be taken only as identifiers, to assist the reader's understanding of the various embodiments, variations and/or modifications of the present disclosure, and may not create any limitations, particularly as to the order, or preference, of any embodiment, variation and/or modification relative to, or over, another embodiment, variation and/or modification.

In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure as set forth in the claims. It is intended that all matter contained in the above description or shown in the accompanying drawings shall be interpreted as illustrative only and not limiting. Changes in detail or structure may be made without departing from the spirit of the present invention as defined in the appended claims.

While an exemplary embodiment has been described and shown in the accompanying drawings, it is to be understood that such an embodiment is merely illustrative of and not restrictive on the broad present disclosure, and that this disclosure may not be limited to the specific constructions and arrangements shown and described, since various other modifications and/or adaptations may occur to those of ordinary skill in the art. It is to be understood that individual features shown or described for the exemplary embodiment in the context of functional segments and such features may be replicated, or be omitted within the scope of the present invention and without departing from the spirit of the present disclosure as may be defined in the appended claims.

The invention claimed is:

1. A panel and frame system, comprising:

a frame having an interior surface, an exterior surface, a hinge jamb, and a lock jamb;

at least one panel, having an interior surface and an exterior surface, hingedly mounted upon said frame by at least one hinge mechanism interconnecting said at least one panel to said hinge jamb of said frame at a location adjacent to said interior surfaces of said frame and said at least one panel, and a retractable/extendible lock bolt mounted upon said at least one panel at a location adjacent to said interior surface of said at least one panel for engaging said lock jamb of said frame at a location adjacent to said interior surface of said frame when said retractable lock bolt is extended to an extended position and when said panel is disposed at a closed position with respect to said frame;

said frame further comprising a hinge jamb step located adjacent to said exterior surface of said frame, and said at least one panel further comprising a first panel step located adjacent to said exterior surface of said at least one panel but interior of said hinge jamb step of said frame and operatively cooperative with said hinge jamb step of said frame so as to prevent access to said hinge mechanism from a position exterior to said at least one panel when said at least one panel is disposed at a closed position with respect to said frame; and said frame further comprising a lock jamb step located adjacent to said exterior surface of said frame, and said at least one panel further comprising a second panel step located adjacent to said exterior surface of said at least one panel but interior of said lock jamb step of said frame and operatively cooperative with said lock jamb step of said frame so as to prevent access to said retractable/extendible lock bolt from a position exterior to said at least one panel when said at least one panel is disposed at a closed position with respect to said frame.

2. The panel and frame system as set forth in claim 1, wherein:

said panel comprises a door; and said frame comprises a door frame.

3. The panel and frame system as set forth in claim 1, wherein:

said hinge jamb of said frame has a substantially L-shaped cross-sectional configuration comprising a relatively long interior hinge jamb face, upon which said at least one hinge mechanism is mounted, disposed toward a first side edge portion of said at least one panel, a relatively short exterior hinge jamb face, and a hinge jamb step interconnecting said exterior hinge jamb face to said interior hinge jamb face and defining a substantially concave corner portion of said hinge jamb of said frame having said substantially L-shaped cross-sectional configuration.

4. The panel and frame system as set forth in claim 3, wherein:

said first panel step of said at least one panel projects outwardly from said first side edge portion of said at least one panel toward said hinge jamb of said frame such that a first relatively long side of said first panel step, upon which said at least one hinge mechanism is mounted, is disposed toward said interior hinge jamb face, a second relatively short side of said first panel step is disposed toward said hinge jamb step, and a substantially convex corner portion of said first panel step is defined at the intersection of said first relatively long side of said first panel step and said second relatively short side of said first panel step.

5. The panel and frame system as set forth in claim 4, wherein:

said hinge jamb of said frame and said first panel step of said at least one panel effectively have complementary configurations such that said substantially concave corner portion of said hinge jamb of said frame will accommodate said substantially convex corner portion of said-first panel step of said at least one panel when said at least one panel is disposed at a closed position with respect to said frame.

6. The panel and frame system as set forth in claim 1, wherein:

said lock jamb of said frame has a substantially L-shaped cross-sectional configuration comprising a relatively long interior lock jamb face upon which a hollow is defined for receiving said retractable/extensible lock bolt and which is disposed toward a second side edge portion of said at least one panel, a relatively short exterior lock jamb face, and a lock jamb step interconnecting said exterior lock jamb face to said interior lock jamb face and defining a substantially concave corner portion of said lock jamb of said frame having said substantially L-shaped cross-sectional configuration.

7. The panel and frame system as set forth in claim 6, wherein:

said second panel step of said at least one panel projects outwardly from said second side edge portion of said at least one panel toward said lock jamb of said frame such that a first relatively long side of said second panel step, upon which said retractable/extensible lock bolt is mounted, is disposed toward said interior lock jamb face, a second relatively short side of said first panel step is disposed toward said hinge jamb step, and a substantially convex corner portion of said first panel step is defined at the intersection of said first relatively long side of said first panel step and said second relatively short side of said first panel step.

8. The panel and frame system as set forth in claim 7, wherein:

said lock jamb of said frame and said second panel step of said at least one panel effectively have complementary configurations such that said substantially concave corner portion of said lock jamb of said frame will accommodate said substantially convex corner portion of said second panel step of said at least one panel when said at least one panel is disposed at a closed position with respect to said frame.

* * * * *